US006179469B1

(12) United States Patent
Ichiryu et al.

(10) Patent No.: US 6,179,469 B1
(45) Date of Patent: Jan. 30, 2001

(54) ROTATION MECHANISM FOR ROTATING A RING

(75) Inventors: Taku Ichiryu; Tadao Yashiki, both of Takasago (JP)

(73) Assignee: Mitsubishi Heavy Industries, Ltd., Tokyo (JP)

( * ) Notice: Under 35 U.S.C. 154(b), the term of this patent shall be extended for 0 days.

(21) Appl. No.: 09/315,231

(22) Filed: May 20, 1999

(30) Foreign Application Priority Data

May 22, 1998 (JP) ..... 10-141495

(51) Int. Cl.[7] ..... F16H 21/40
(52) U.S. Cl. ..... 384/96; 415/160
(58) Field of Search ..... 74/96; 415/160, 415/161, 162

(56) References Cited

U.S. PATENT DOCUMENTS 4,003,675 1/1977 Stevens et al. .
4,955,788 9/1990 Kimura et al. .

FOREIGN PATENT DOCUMENTS 1430609 8/1973 (GB) .
59-7708 1/1984 (JP) .

*Primary Examiner*—Lenard A. Footland
(74) *Attorney, Agent, or Firm*—Evenson, McKeown, Edwards & Lenahan, P.L.L.C.

(57) ABSTRACT

A rotation mechanism for rotating a rotary ring which has the following features:

the number of parts it requires will be reduced as much as possible; its configuration will be simple and economical to build; the operating drag of the ring will be low; any distortion resulting from the load or thermal expansion will be reliably absorbed; and the ring will be rotated reliably with a small operating force. This rotation mechanism rotates an annular rotation ring in which two follower links are connected to the periphery of the rotation ring in such a way that they are free to rotate. The follower links act to provide coupled forces to rotate the rotation ring. The central portion of a drive lever is rotatably mounted by an operating pin on the end of an operating lever which rotates on an operating shaft. Two drive links, each of which is connected at one end to a respective one of the follower links, are joined by pins to either end of the drive lever in such a way that they are free to rotate. When the operating lever is rotated, the force is transmitted via the drive lever and drive links to the follower links, which move simultaneously to form a couple.

5 Claims, 7 Drawing Sheets

ROTATION MECHANISM FOR ROTATING A RING

BACKGROUND OF THE INVENTION

1. Field of the Invention

This invention concerns a rotation mechanism which provides a couple for, and thus rotates, an annular ring such as that used to drive the fins in a rotation mechanism for rotating the adjustable fins of a gas turbine.

2. Description of the Invention

A rotation apparatus for varying the angle of and rotating the static fins in a gas turbine is shown in FIG. 1. (This figure is a preferred embodiment of the present invention and not an example of the prior art.) Rotary shafts 2*a* of (static) fins 2, which are rotatably mounted in compartment 1, are connected to rotation ring 4 through levers 3. When the rotation ring 4 is rotated, the fins 2 rotate as indicated by the arrows in FIG. 1.

The rotation ring 4 has a number of supports 6 on it which are supported by washers 5 on the surface of compartment 1 when the ring rotates.

Although only a single fin 2 is shown in FIG. 1, the relevant gas turbine in fact has a number of such fins at regular intervals around the periphery of compartment 1. When the rotation ring 4 rotates, all the fins 2 rotate simultaneously.

An example of a rotation mechanism for rotating the ring which drives the fins in a gas turbine is a single link 10 which rotates rotation ring 4, as provided in Japanese Patent Publication (Kokai) Showa 59-7708. With this design, the force which rotates rotation ring 4 is balanced with the opposing force to supports 6 on rotation ring 4. However, in this rotation mechanism, the radius of rotary shaft 2*a* of fin 2, which is supported in the compartment 1, and the point of action of the force are in a ratio of nearly 1:1. Thus the drag torque due to friction will be considerable.

Further, the radius of the rotation ring 4 is greater than that of compartment 1, and consequently the ring is more prone to warping. All of the above-mentioned factors have an adverse effect on the smooth operation of the rotation mechanism which rotates rotation ring 4.

The rotation devices which the prior art provides to solve the problems discussed above are the rotation mechanisms pictured in FIGS. 9, 10 and 11, which rotate rotation ring 4 through a couple.

FIGS. 9 and 10 show a prior art rotation mechanism for rotating the ring which drives the rotation of the fins.

In FIGS. 9 and 10, 4 is the rotation ring which rotates fins 2 as shown in FIG. 1.

Pins 51 and 52 are inserted through holes on opposite sides of the outer edge of the rotation ring 4. One end of each of the follower links 10 and 11 is rotatably mounted to the pins 51 and 52, respectively.

Operating lever 17 is rotatably mounted through operating shaft 18 to bracket 43, which is fixed to the top of stage 40 (See FIG. 1).

Pin 200 is inserted through one end of the lever 17. One end of each of links 14 and 15 is rotatably mounted in the pin 200, as is shown in FIG. 10.

To the left and right of the bracket 43 are brackets 41 and 42, both of which are also fixed to the stage 40. L-shaped levers 12 and 13, which face in opposite directions, are rotatably mounted to brackets 41 and 42, respectively, through lever shafts 56 and 55.

The other end of link 14 is connected through pin 58, in such a way that the link is free to rotate, to one end of L-shaped lever 12, the lever on the right side of the rotation mechanism. The other end of link 15 is connected through pin 57, in such a way that the link is free to rotate, to one end of lever 13, the lever on the left side of the rotation mechanism.

The other end of the L-shaped lever 12 is connected through pin 53 to the free end of follower link 10. The other end of the L-shaped lever 13 is connected through pin 54 to the free end of follower link 11.

With this sort of rotation mechanism for the rotation ring, a drive means, such as a servo hydraulic cylinder (not shown), rotates operating lever 17, through the mediation of the operating shaft 18, in the direction shown by arrow Z1 in FIG. 9. When this happens, links 14 and 15 move horizontally to the right, as indicated by arrow Z2. L-shaped lever 12 rotates counterclockwise on shaft 56, as shown by arrow Z3. L-shaped lever 13 also rotates counterclockwise on its lever shaft 55, as shown by arrow Z4. Link 10 on the right side moves upward as shown by arrow Z5; link 11 on the left side moves downward as shown by arrow Z6.

Thus the links 10 and 11 provide a couple to rotation ring 4, which rotates counterclockwise as shown by arrow Z7. As the rotation ring 4 rotates, fins 2 are rotated in the specified direction.

In the prior art design shown in FIGS. 9 and 10, links 10 and 11, which drive rotation ring 4, are connected to opposite sides of the rotation ring. The forces which operate on rotation ring 4 are coupled. Because the load which is concentrated at a single point diminishes, the resultant force which acts on support 6 approaches zero. There is less warping and friction, the rotation mechanism operates smoothly, and the operating force itself decreases.

In the prior art design shown in FIGS. 9 and 10, however, links 14 and 15 are directly attached to a single pin 200, which is mounted to one end of operating lever 17, and so they move left and right. Thus links 14 and 15 have very little freedom and must move at an excessive speed, which may result in increased frictional drag. Also, a large operating force is needed to drive rotation ring 4 through the links 14 and 15. The configuration makes it difficult to eliminate the effects of warping due to the load on links 14 and 15 and the levers connected to them or due to the thermal expansion of these components, which in turn may result in excessive operating force or defective operation.

The prior art device shown in FIG. 11 is a rotation mechanism for driving the rotation of the rotation ring 4 using a driving means such as a servo hydraulic cylinder.

In this design, two cylinders, namely servo oil hydraulic cylinder 60 and slave cylinder 61, are arranged symmetrically 180° apart and connected by pipes 64 and 65. The free end of piston rod 66 of servo oil hydraulic cylinder 60 is connected to pin 51 on the outer edge of rotation ring 4. The free end of piston rod 67 of slave cylinder 61 is connected to pin 52, which is 180- opposite pin 51 on the outer edge of rotation ring 4.

When piston 62 of cylinder 60 is hydraulically driven, piston rod 66 moves in the direction indicated by arrow $Y_1$ and piston rod 67 of slave cylinder 61 moves in the direction indicated by arrow $Y_2$. The couple generated in this way rotates rotation ring 4 in the direction indicated by arrow $Y_3$.

If a turbine has multiple rows of fins to be driven, a rotation mechanism using a servo hydraulic cylinder as in the prior art device pictured in FIG. 11 will require a set of hydraulic drive components including a servo hydraulic cylinder 60 and a slave cylinder 61 for each row. This drives up the parts count and increases the cost of the device. Furthermore, the relative forces between the cylinder equipped with a pilot relay (servo hydraulic cylinder 60) and slave cylinder 61 may be unbalanced so that it becomes impossible to achieve the required operating force.

SUMMARY OF THE INVENTION

In view of the shortcomings inherent in the prior art, the object of the present invention is to provide a rotation mechanism for rotating a rotary ring which has the following features: the number of parts it requires will be reduced as much as possible; its configuration will be simple and economical to build; the operating drag of the ring will be low; any distortion resulting from the load or thermal expansion will be reliably absorbed; and the ring will be rotated reliably with a small operating force.

The first embodiment of this invention developed to solve these problems is a rotation mechanism for rotating an annular rotation ring in which two follower links are connected to the periphery of the rotation ring in such a way that they are free to rotate. The follower links act to provide coupled forces to rotate the rotation ring. The central portion of a drive lever is rotatably mounted by an operating pin on the end of an operating lever which rotates on an operating shaft.

The two drive links, which are each connected at one end to one of the follower links, are joined by pins to either end of the drive lever in such a way that they are free to rotate. When the operating lever is rotated, the force is transmitted via the drive lever and drive links to the follower links, which move simultaneously to form a couple. These features constitute the attributes which distinguish this rotation mechanism for rotating a ring.

With this invention, when the operating lever is actuated, the drive lever moves along with its operating pin. This applies coupled forces to the rotation ring in the form of the two drive links connected via pins to each end of the drive lever, thus causing the ring to rotate. When this occurs, any warping due to deformation caused by the load on the links connected to the drive components on the rotation ring or to thermal expansion of the links, will be absorbed by the rotation of the drive lever, which has a single degree of freedom, on its operating pin.

This design will prevent excessive binding in the drive system for the rotation ring and thus also prevent the statically indeterminate reaction force which it produces. It allows the operating force to be distributed uniformly to the drive system on both sides of the rotation ring.

The second preferred embodiment of this invention is a rotation mechanism for rotating an annular rotation ring in which two follower links are connected to the periphery of the rotation ring in such a way that they are free to rotate. The follower links act to provide coupled forces to rotate the rotation ring. The two drive links, which are each connected at one end to one of the follower links, are connected to the end of an operating lever via a spherical joint in such a way that they are free to rotate.

When the operating lever is rotated, the force is transmitted through the spherical joints and drive links to the two follower links simultaneously so as to create a couple. These are the features which distinguish this rotation device for rotating a ring.

With this invention, any warping of the link system between the operating lever and the rotation ring will be absorbed by the spherical joints. Binding will not result in statically indeterminate reaction force, and little operating force will be needed to rotate the ring, even if the drive ring is oriented horizontally.

1: compartment, 2: Fin, 4: Rotation ring, 5: Washer, 6: Support, 10,11: follower links, 12,13: L-shaped lever, 18: Shaft (Operating shaft), 19,20: Pins, 21: Pin (Operating pin), 30,31,32: Spherical bushings, 41,42,43: Bracket, 51,52: Pins (for rotation ring), 53,54: Pins, 55,56: Lever shafts, 57,58: Pins, 60: Spherical bushings (pin side), 210: Pin.

DETAILED DESCRIPTION OF PREFERRED EMBODIMENTS

In this section we shall give a detailed explanation of the invention with reference to the drawings figures. To the extent that the dimensions, materials, shape and relative position of the components described in these embodiments need not be definitely fixed, the scope of the invention is not limited to the embodiments as described herein, which are meant to serve merely as examples.

Figure 1:
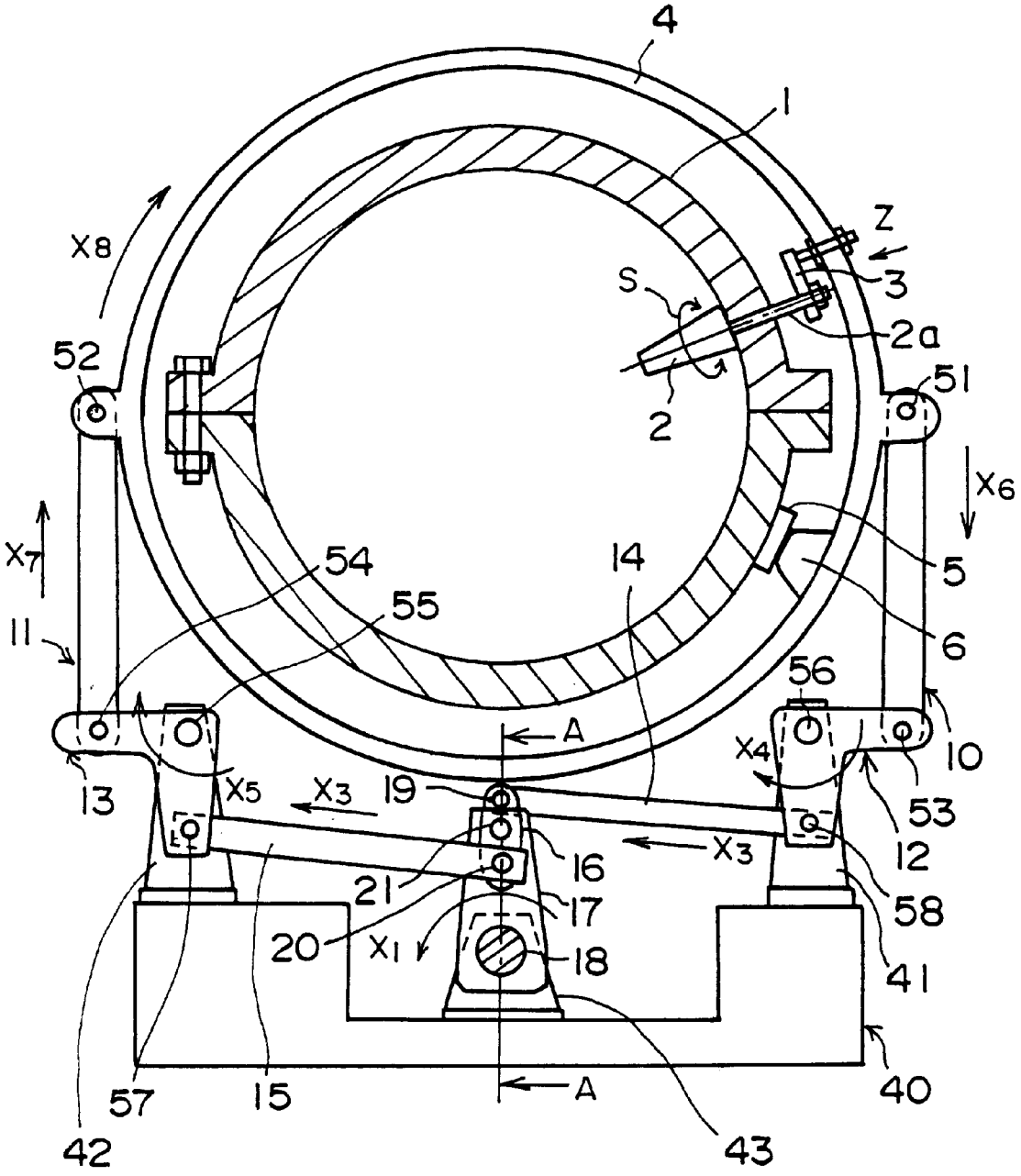
FIG. 1 is a front view of a rotation mechanism for rotating the rotation ring which drives the adjustable static fins of a gas turbine which is a first preferred embodiment of this invention.
Figure 2:
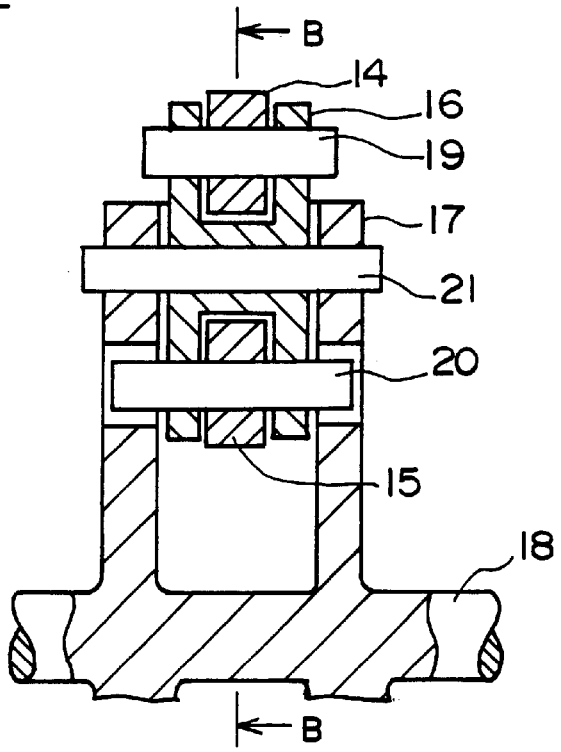
FIG. 2 is a cross section taken along line A—A in FIG. 1.
Figure 3:
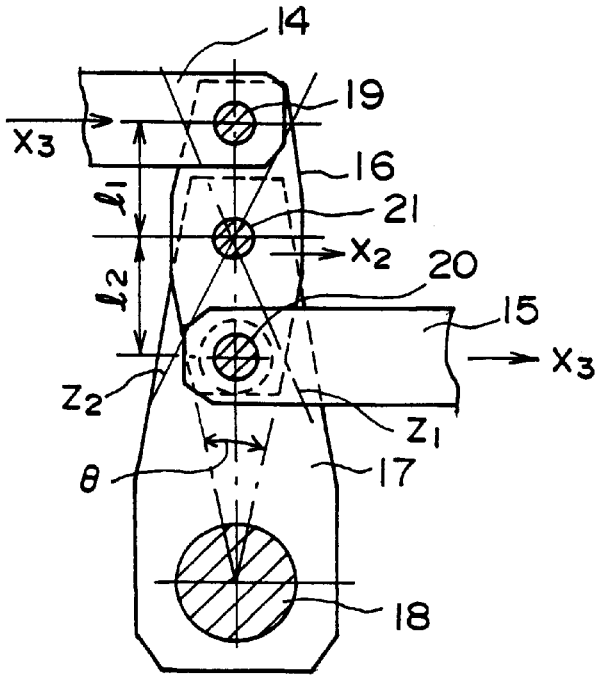
FIG. 3 is a cross section taken along line B—B in FIG. 2.
Figure 4:
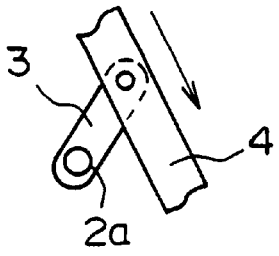
FIG. 4 is an oblique view taken in the direction of arrow Z in FIG. 1.

FIG. 1 is a front view of a rotation mechanism for rotating the ring which drives the adjustable static fins of a gas turbine which is a first preferred embodiment of this invention. FIG. 2 is a cross section taken along line A—A in FIG. 1. FIG. 3 is a cross section taken along line B—B in FIG. 2. FIG. 4 is an enlargement of the view from arrow Z in FIG. 1.

In FIGS. 1 through 4, 1 is the compartment, 2 is one of a number of adjustable static fins (hereafter referred to simply as "fins") which are arrayed at regular intervals on the periphery of the compartment, 2*a* is the rotary shaft of the fin 2, and 4 is the rotation ring which rotates the fin 2.

The rotation ring 4 has a number of supports 6, which are supported by washers 5 provided on the compartment 1 so that the rotation ring can rotate with respect to the compartment.

The rotary shaft 2*a* of the fin 2 is connected to the rotation ring 4 through lever 3. When the rotation ring 4 is rotated, the fin rotates as indicated by arrows S in FIG. 1.

40 is the stage. 43 is a bracket which is fixed to the center of the stage 40. Operating lever 17 is rotatably mounted to the bracket 43 by an operating shaft 18, both ends of which are supported by the bracket. The operating shaft 18 is connected to a drive source such as a servo hydraulic cylinder.

Operating pin 21 is inserted at the end of the operating lever 17. As can be seen in FIGS. 2 and 3, the center of drive lever 16, whose end portions have a cross section like an angular letter "C", is rotatably mounted to the operating pin 21.

As can be seen in FIG. 2, pin 19 goes through one of the C-shaped ends of the drive lever 16. One end of horizontal drive link 14 is rotatably mounted to pin 19. Pin 20 goes through the other C-shaped end of the drive lever 16. One end of horizontal drive link 15 is rotatably mounted to pin 20.

To the left and right of the bracket 43, brackets 41 and 42 are fixed respectively to the stage 40. L-shaped levers 12 and 13, which face in opposite directions, are rotatably mounted to brackets 41 and 42 by shafts 56 and 55, respectively.

The free end of the drive link 14 is connected, via pin 58, to one end of the L-shaped lever 12 on the right side of the rotation mechanism. The free end of the drive link 15 is connected, via pin 57, to one end of the L-shaped lever 13 on the left side of the rotation mechanism.

The other end of the L-shaped lever 12 is connected, via pin 53, to one end of the follower link 10. The other end of L-shaped lever 13 is connected, via pin 54, to one end of the follower link 11. In the above example, the rotation mechanism is used to rotate fin 2 in a single row of fins. To rotate a number of rows of fins simultaneously, that number of rotation mechanisms like the one shown above would be used.

In a rotation mechanism for rotating a rotation ring with this sort of configuration, a drive means such as a servo hydraulic cylinder (not shown) will, via the operating shaft 18, move operating lever 17 in the direction indicated by arrow $X_1$ in FIG. 1. (2 In FIG. 3 shows lever 17's range of rotation.) Operating pin 21 causes drive lever 16 to be pushed in the direction indicated by arrow $X_2$ in FIG. 3. Drive links 14 and 15 move in the direction indicated by arrow $X_3$ in FIG. 3.

This causes L-shaped lever 12 to rotate clockwise on lever shaft 56 and L-shaped lever 13 to rotate clockwise on lever shaft 55 as shown by arrows $X_4$ and $X_5$.

Follower link 10 on the right side of the rotation mechanism moves downward as indicated by arrow $X_6$, and follower link 11 on the left side of the rotation mechanism moves upward as indicated by arrow $X_7$.

The follower links 10 an 11 apply coupled forces to rotating ring 4. The rotation ring 4 rotates clockwise as indicated by arrow $X_8$. When the rotation ring 4 rotates, fin 2 rotates along with it in the specified direction.

If there is any play (gap) associated with drive link 14, and the rotation mechanism operates as described above, drive link 15 moves in direction X3, and the reaction force will be generated in the opposite direction. However, because the drag force on link 14 is very slight until the play disappears, link 15 will remain at rest while link 14 alone is pulled. Drive lever 16 will rotate counterclockwise on operating pin 21 and move left as a whole (arrow $X_3$) with the rotation of the operating lever 17.

The drive lever 16 will continue to rotate until the play associated with the drive link 14 is eliminated and drag force is generated. When the drive lever 16 has stopped rotating and rotation ring 4 is still rotating, the moments of the reaction force operating on drive lever 16 around operating pin 21 are in balance. Because length 11 from the center of operating pin 21 to the center of pin 19 in FIG. 3 is equal to length 12 from the center of operating pin 21 to the center of pin 20, the force operating on drive links 14 and 15 will also be equal.

If the ratio of the force operating on the drive links 14 and 15 should change, the position of operating pin 21 will change and the ratio of the lengths 11 and 12 will change.

With this sort of rotary mechanism, if the links should warp or experience thermal expansion due to the force driving rotation ring 4 (i.e., the load), they will be deformed. However, the cumulative value of this deformation will be absorbed because the drive lever 16 has a single degree of freedom, and it can only rotate on operating pin 21 between lines $Z_1$ and $Z_2$ in FIG. 3.

With this embodiment, then, any deformation of the links due to the force associated with driving rotation ring 4 (the load) or to thermal expansion will be absorbed when the drive lever 16 in FIG. 3 rotates between lines $Z_1$ and $Z_2$, creating a statically determinate structure. This will prevent excessive binding in the link system which drives rotation ring 4 as well as the statically indeterminate reaction force which would be generated by this binding. It will assure that equal operating force is applied to follower links 10 and 11.

Figure 5:
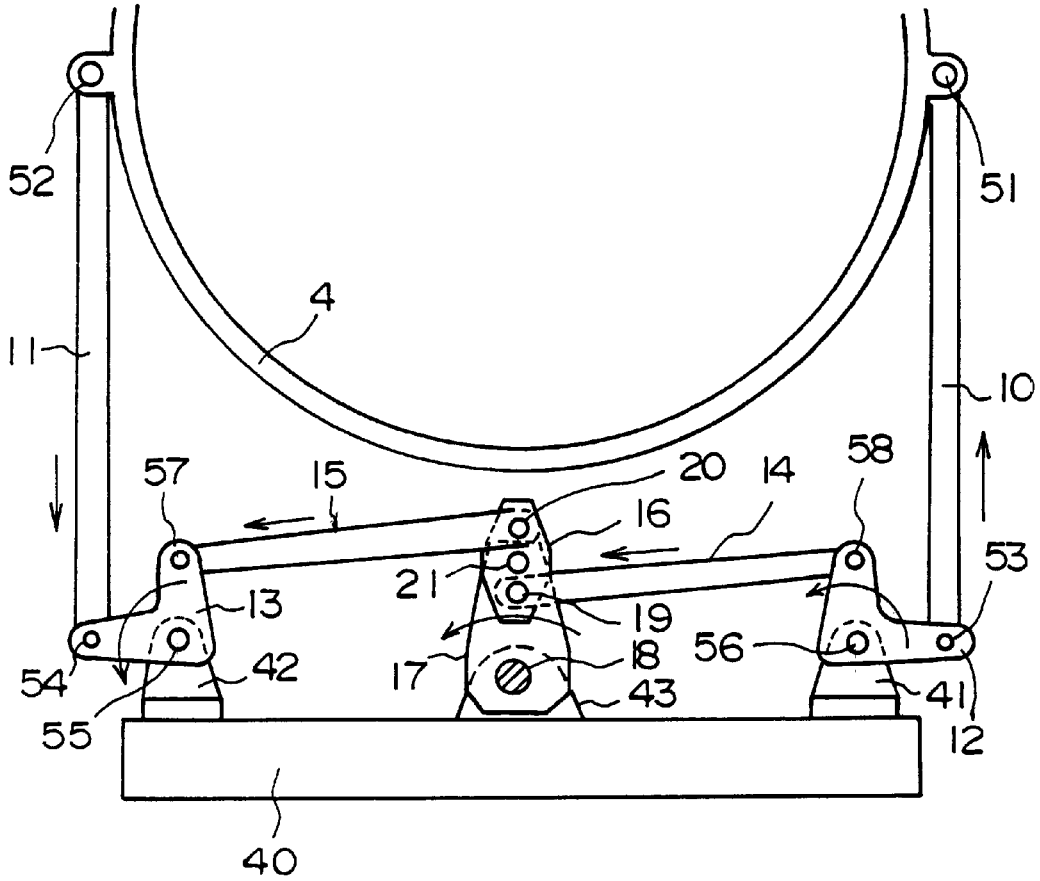
FIG. 5 is view corresponding to FIG. 1, of a second preferred embodiment of this invention.

FIG. 5 is a view corresponding to FIG. 1, of a second preferred embodiment of this invention.

In this embodiment, L-shaped levers 12 and 13 on the left and right sides of the rotation mechanism are oriented vertically just opposite the way they were oriented in the first embodiment pictured in FIGS. 1 through 4.

Here the heights of bracket 43, which supports operating lever 17, and of brackets 41 and 42, which support L-shaped levers 12 and 13, are not as high as those of the corresponding components in the first embodiment. This makes it possible for all three brackets, 43, 42 and 41, to be mounted on the same surface, which simplifies the mechanism.

Figure 6:
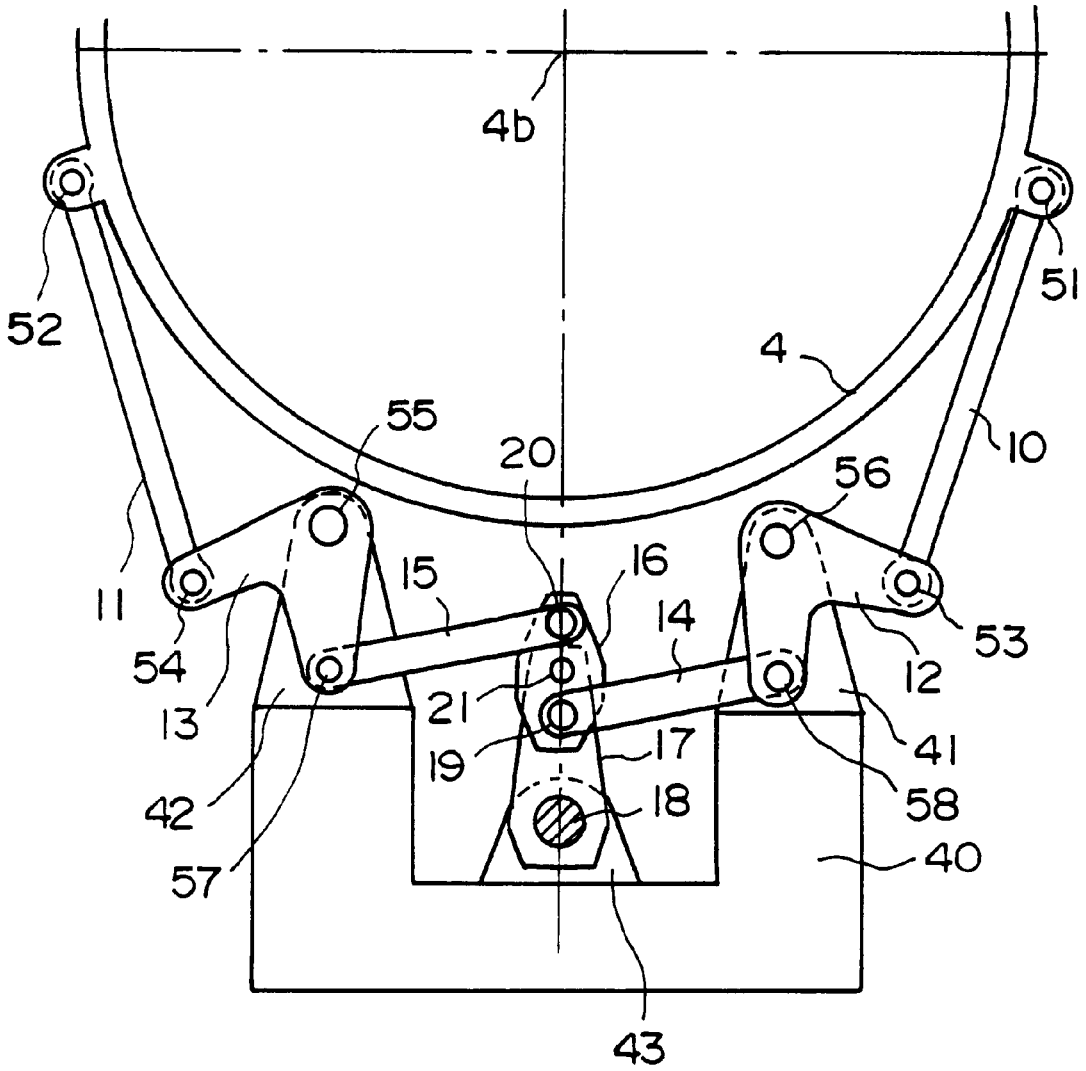
FIG. 6 is a view corresponding to FIG. 1, of a third preferred embodiment of this invention.

FIG. 6 is a view corresponding to FIG. 1, of a third preferred embodiment of this invention.

In this embodiment, the positions of pins 51 and 52, the couplings which deliver the force to rotate rotation ring 4, have been shifted to somewhat below the center 4*b* of rotation ring 4.

As a result, follower links 10 and 11 in this embodiment are oriented downward and inclined slightly inward. The shapes of L-shaped levers 12 and 13, which are connected to the follower links 10 and 11, form acute angles with respect to lever shaft 56.

To drive a rotation ring 4 in a rotation mechanism configured as discussed above, in which the positions of pins 51 and 52, the couplings which drive the rotating ring, are shifted somewhat downward from the center of the ring, a drive lever 16 is interposed between drive links 14 and 15 and operating lever 17. This forms a system with a single degree of freedom which can absorb any deformation of the link system. Such a configuration prevents statically indeterminate reaction force from being generated in the link system and produces a couple which can drive the ring with only slight resistance.

Figure 7:
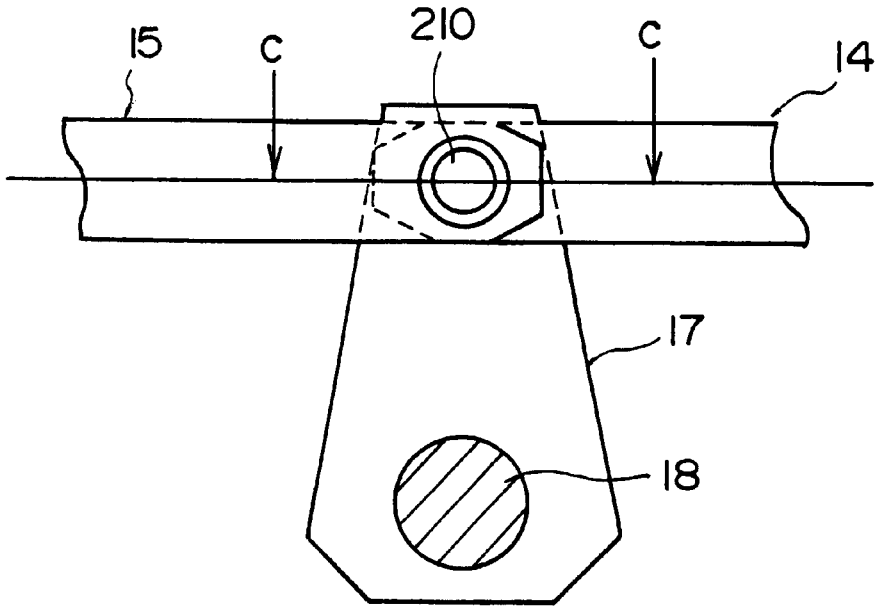
FIG. 7 is a front view near the operating lever which is a fourth preferred embodiment of this invention.
Figure 8:
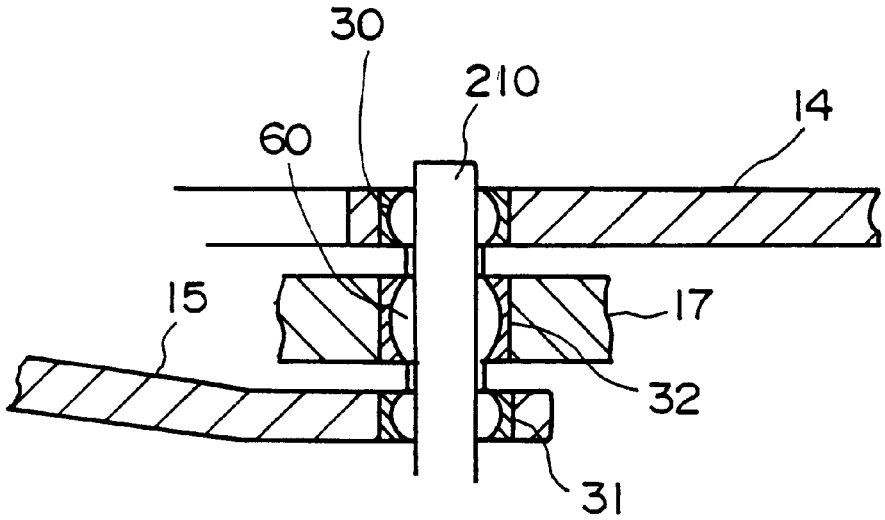
FIG. 8 is a cross section taken along line C—C in FIG. 7.
Figure 9:
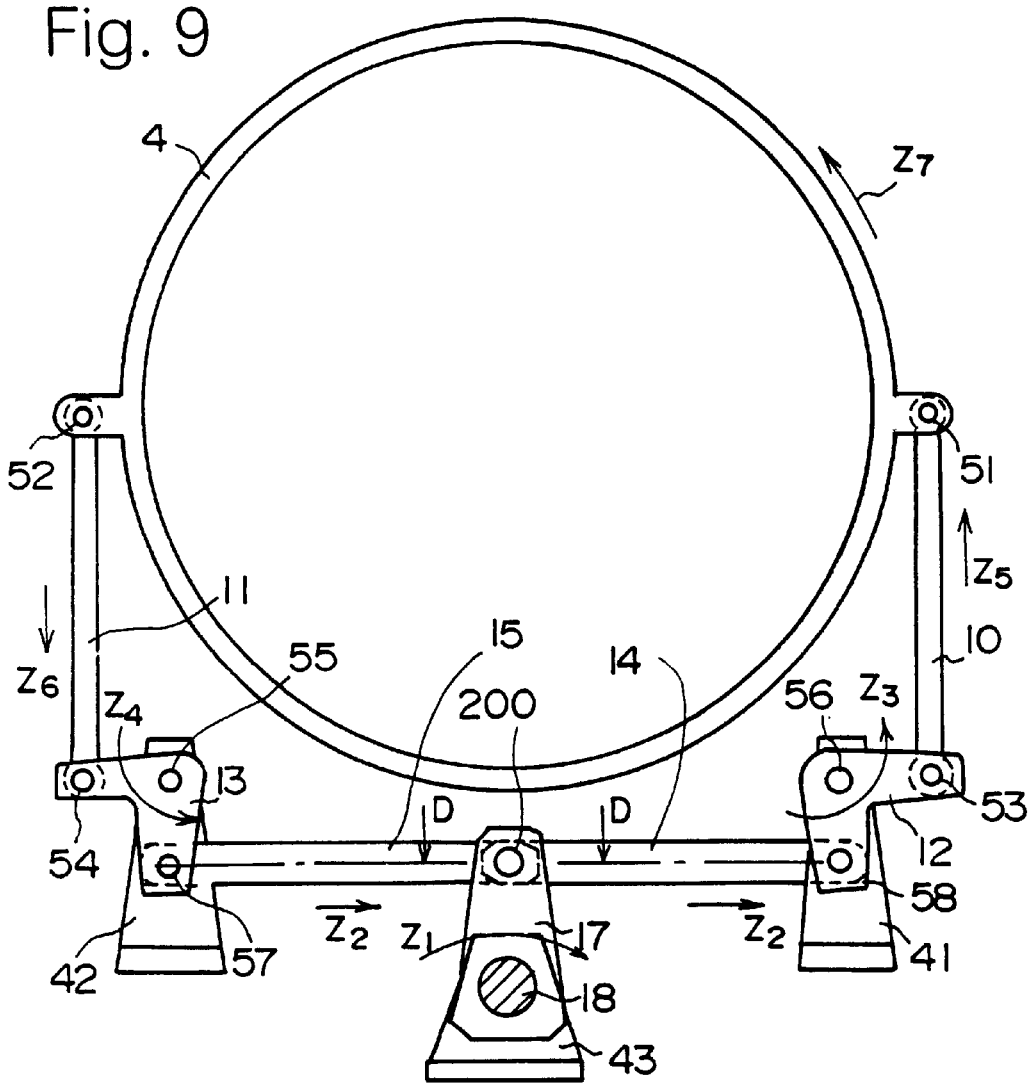
FIG. 9 is a view corresponding to FIG. 1, of a first prior art mechanism.
Figure 10:
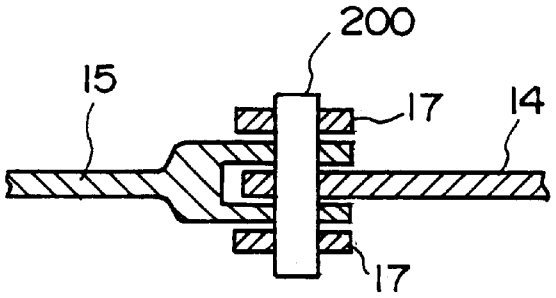
FIG. 10 is a cross section taken along line D—D in FIG. 9.
Figure 11:
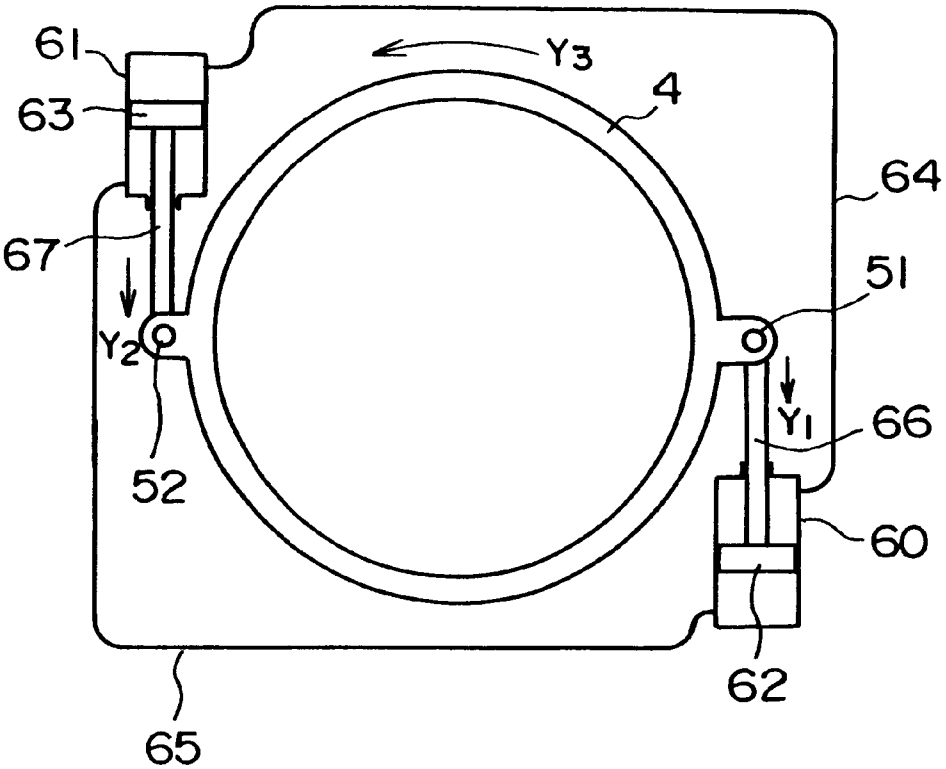
FIG. 11 is a view corresponding to FIG. 1, of a second prior art mechanism.

FIGS. 7 and 8 show a fourth preferred embodiment of this invention.

In this embodiment, drive links 14 and 15 are arranged in the same horizontal plane. In FIGS. 7 and 8, 210 is the pin which goes through the end of the operating lever 17.

In the center of the pin 210 is a joint for the operating lever 17. At either end of pin 210 are joints for drive links 14 and 15.

60 is a spherical bushing which is pressed onto the outer periphery of the pin 210. Spherical surfaces (to be discussed shortly) have been created in three places on this outer periphery so as to engage with spherical bushings 32, 30 and 31.

32 is a spherical bushing which is attached to the inner periphery of the operating lever 17. 30 and 31 are spherical bushings attached to the inner peripheries of the drive links 14 and 15. When all three of bushings 32, 30 and 31 engage with spherical bushings 60 on the pin 210, they form a spherical joint.

With this embodiment, then, any distortion resulting from the bending or sagging of the horizontal link system will be absorbed by the spherical joint. Such a configuration prevents statically indeterminate reaction force from being generated and permits rotation ring 4 to be rotated with very little operating force.

As is disclosed herein, with this invention, a drive lever or a spherical joint is placed between the operating lever and the system of links for driving the rotating ring. With this very simple system, any distortion between the operating lever and the drive components resulting from the load on the link system or from thermal expansion will be reliably absorbed.

This design will prevent excessive binding in the link system and thus will also prevent the statically indeterminate reaction force which it produces. It allows the rotation of the ring to be driven reliably using very little operating force.

What is claimed is:

1. A rotation mechanism for rotating an annular rotation ring, comprising:

a pair of follower links, each of which is connected at one end to the periphery of said rotation ring in such a way that said follower links are free to rotate;

a pair of drive links, each of which is free to rotate at both ends;

an operating lever which rotates on an operating shaft; and a drive lever rotatably mounted at a central portion thereof by an operating pin to an end of said operating lever; ends of said drive lever being connected by pins to respective other ends of said pair of drive links, and said operating lever being connected to said drive links in such a way that, when said operating lever is rotated, the rotation force is transmitted via said drive lever and said pair of drive links to said pair of follower links, which move simultaneously to exert a coupled force to rotate said rotation ring.

2. A rotation mechanism according to claim 1, wherein said rotation ring is provided to vary the angle of static fins in a compartment of gas turbine by a rotation of said rotation ring.

3. A rotation mechanism for rotating an annular rotation ring, comprising:

a pair of follower links, each of which is connected at one end to the periphery of said rotation ring in such a way that said follower links are free to rotate;

a pair of drive links, each of which is free to rotate at both ends;

an operating lever which rotates on an operating shaft; said operating lever being connected by spherical joints to respective other ends of said pair of drive links in such a way that, when said operating lever is rotated, the rotation force is transmitted via said drive lever and said pair of drive links to said pair of follower links, which move simultaneously to exert a coupled force to rotate said rotation ring.

4. A rotation mechanism for rotating an annular rotation ring, comprising:

a pair of follower links, each of which is connected by pin at one end to the periphery of said rotation ring in such a way that said follower links are free to rotate;

a pair of L-shaped levers, each of which is connected by pin at one end to the other end of said follower link in such a way that said L-shaped levers are free to rotate;

a pair of drive links, each of which is connected by pin at one end to the other end of said L-shaped lever;

an operating lever which rotates on an operating shaft; and a drive lever rotatably mounted at a central portion thereof by an operating pin to an end of said operating lever; ends of said drive lever being connected by pins to respective the other ends of said pair of drive links, and said operating lever being connected to said drive links in such a way that, when said operating lever is rotated, the rotation force is transmitted via said drive lever, said pair of drive links, and said pair of L-shaped levers to said pair of follower links, which move simultaneously to exert a coupled force to rotate said rotation ring.

5. A rotation mechanism for rotating an annular rotation ring, comprising:

a pair of follower links, each of which is connected at one end to the periphery of said rotation ring in such a way that said follower links are free to rotate;

a pair of L-shaped levers, each of which is connected by pin at one end to the other end of said follower link in such a way that said L-shaped levers are free to rotate;

a pair of drive links, each of which is connected by pin at one end to the other end of said L-shaped lever; and an operating lever which rotates on an operating shaft;

wherein said pair of drive links are connected by spherical joints to said one end of said operating lever in such a way that, when said operating lever is rotated, the rotation force is transmitted via said spherical joints, said pair of drive links, and said pair of L-shaped levers to said pair of follower links, which move simultaneously to exert a coupled force to rotate said rotation ring.

* * * * *